United States Patent [19]

Rosenberg

[11] Patent Number: 4,957,240

[45] Date of Patent: Sep. 18, 1990

[54] ROTARY SPRINKLERS

[76] Inventor: Peretz Rosenberg, Moshav Beit Sharim, Israel

[21] Appl. No.: 249,018

[22] Filed: Sep. 26, 1988

[30] Foreign Application Priority Data

Oct. 1, 1987 [IL] Israel ..... 84068

[51] Int. Cl.[5] ..... B05B 3/02

[52] U.S. Cl. ..... 239/233; 239/246; 239/381

[58] Field of Search ..... 239/233, 222.15, 222.17, 239/222.19, 247, 251, 255, 380, 381, 389, 246

[56] References Cited

U.S. PATENT DOCUMENTS

| | | | |
|---|---|---|---|
| 2,792,256 | 5/1957 | Sinex | 239/233 |
| 3,680,778 | 8/1972 | Sisson et al. | 239/233 |
| 3,871,582 | 3/1975 | Biddle | 239/233 |
| 3,924,809 | 12/1975 | Troup | 239/233 |
| 3,966,122 | 6/1976 | Drori | 239/233 |
| 4,537,356 | 8/1985 | Lawson | 239/233 |
| 4,595,141 | 6/1986 | Cherundolo et al. | 239/233 |
| 4,754,925 | 7/1988 | Rubinstein | 239/381 |
| 4,805,838 | 2/1989 | Greenberg | 239/222.17 |

*Primary Examiner*—Andres Kashnikow
*Assistant Examiner*—Michael J. Forman
*Attorney, Agent, or Firm*—Benjamin J. Barish

[57] ABSTRACT

A rotary sprinkler includes an impact member carried by a rotary nozzle for periodically receiving impacts to rotate the nozzle about its mounting, and a rotary deflector in the path of the water jet discharged from the nozzle and having a surface effective to periodically direct at least a portion of the water jet against the impact member to rotate the nozzle about its mounting.

19 Claims, 3 Drawing Sheets

FIG 5
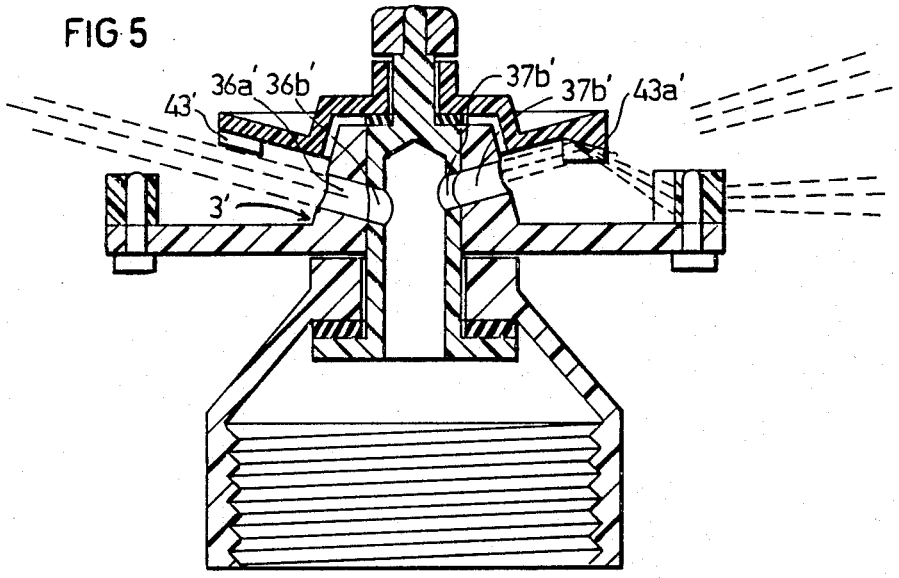
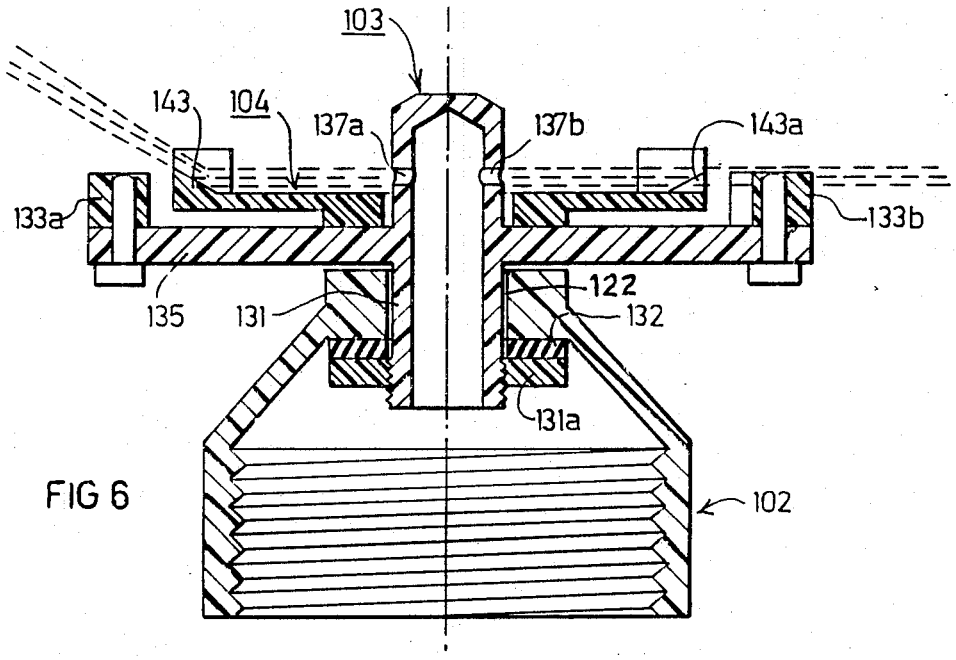
FIG 6

ROTARY SPRINKLERS

BACKGROUND OF THE INVENTION

The present invention relates to rotary sprinklers, and particularly to the impact-type rotary sprinklers widely used in water-irrigation systems.

Impact-type rotary sprinklers commonly include a nozzle rotatably mounted to a mounting member and formed with an orifice for discharging a water jet, and an impact member carried by the nozzle for periodically receiving impacts effective to rotate the nozzle about its mounting. In the conventional impact-type rotary sprinkler, the impact member is usually in the form of an abutment which periodically receives mechanical impacts from a mechanical member carried by the nozzle, such as from a pivotably-mounted hammer which is deflected away from the abutment by the water jet discharged by the nozzle orifice and is spring-urged towards the abutment to impact it during the return pivotal movement. A disadvantage of the conventional impact-type rotary sprinklers is that mechanical impacts of one solid member against another produces wear and tear on the impacted surfaces, which decreases the useful life of the water sprinkler and increases the need for frequent adjustment, repair, and/or replacement of parts, in order to maintain proper operation of the sprinklers.

An object of the present invention is to provide a novel impact-type rotary sprinkler having advantages in the above respects.

BRIEF SUMMARY OF THE INVENTION

According to the present invention, there is provided a rotary sprinkler including a mounting, a nozzle rotatably mounted thereon and formed with an orifice for discharging a water jet, and an impact member carried by the nozzle for periodically receiving impacts effective to rotate the nozzle about its mounting.

The sprinkler further includes a rotary deflector rotatably mounted with respect to the nozzle and having a circular array of a plurality of vanes in the path of the water jet effective to be impinged by the water jet and thereby to rotate the deflector. The deflector includes jet-directing means in the path of the water jet at a predetermined angular position of the deflector with respect to the nozzle and effective, when the deflector is in the predetermined angular position, to direct at least a portion of the water jet against the impact member to rotate the nozzle about its mounting. characterized in that the sprinkler further includes a deflector in the path of the water jet discharged from the nozzle and having a surface effective to periodically direct at least a portion of the water jet against the impact member to rotate the nozzle about its mounting.

It will thus be seen that a basic difference in the novel sprinkler of the present invention, as compared to that of the conventional impact-type rotary sprinkler, is that the sprinkler nozzle of the present invention is rotated by periodic impacts produced, not between two solid bodies, but rather between a liquid body (the water jet) and a solid body (the impact member on the nozzle). Accordingly, the novel arrangement substantially reduces wear and tear on the impact member, thereby substantially increasing the useful life of the water sprinkler as well as decreasing the need for frequent adjustment, repair or replacement of parts.

In some described embodiments, the jet-directing means comprises a further vane dissimilar from the plurality of vanes and effective to deflect at least a portion of the water jet against the impact member when the deflector is in the predetermined angular position with respect to the nozzle. In other described embodiments, the jet-directing means comprises a space between the similar vanes at the predetermined angular position of the deflector with respect to the nozzle, which space is effective to permit at least a portion of the water jet to impinge against the impact member when the deflector is in the predetermined angular position with respect to the nozzle.

Further features and advantages of the invention will be apparent from the description below.

BRIEF DESCRIPTION OF THE DRAWINGS

The invention is herein described, by way of example only, with reference to the accompanying drawings, wherein:

FIG. 5 is a view similar to that of FIG. 1 but illustrating a modification;

FIG. 6 is a longitudinal sectional view illustrating another form of rotary sprinkler constructed in accordance with the present invention;

DESCRIPTION OF PREFERRED EMBODIMENTS

Figure 1:
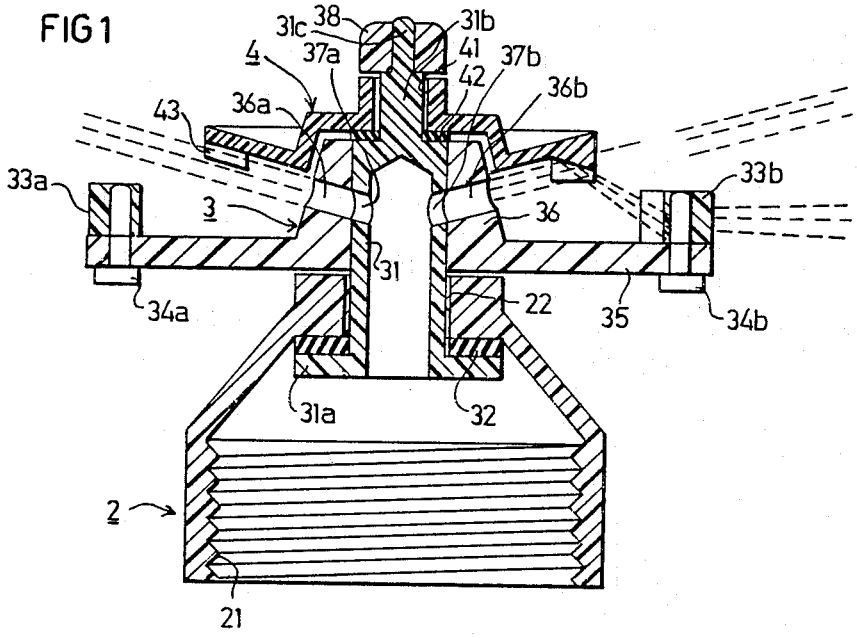
FIG. 1 is a longitudinal sectional view illustrating one form of rotary sprinkler constructed in accordance with the present invention.

The sprinkler illustrated in FIGS. 1–4 of the drawings comprises three basic parts, namely: a mounting member, generally designated 2, for mounting the sprinkler to a source of pressurized water, e.g., a vertical riser pipe (not shown); a nozzle, generally designated 3, including one or more orifices (two being shown in FIG. 1) for discharging water jets laterally of the sprinkler; and a rotary deflector 4 rotatably mounted on the nozzle and having vanes impinged by the water jet (or jets) discharged from the nozzle so as to rotate the deflector on the nozzle 3, and also to rotate the nozzle on its mounting 2. As in the conventional impact-type rotary sprinkler, nozzle 3 is rotated about its mounting 2 by receiving periodic impacts during the operation of the sprinkler. However, as distinguished from the conventional rotary sprinklers wherein the impacts are produced between two solid bodies, the sprinkler illustrated in FIGS. 1–4, as well as those illustrated in the other figures, is rotated by impacts produced between a liquid body, namely a portion of the water jet, and a solid body, namely an impact member carried by the nozzle.

Mounting 2 is formed with internal threads 21 for attachment to an externally-threaded riser pipe (not shown). This mounting is also formed with a central opening 22 for rotatably receiving the nozzle 3.

Nozzle 3 is formed with a hollow cylindrical section 31 received within mounting opening 22 and terminating in an annular flange 31*a* engageable with a plastic bearing disc 32 interposed between the flange and the inner face of the mounting. A pair of impact members 33*a*, 33*b* are fixed by pins 34*a*, 34*b* to the ends of a carrier member 35 having a central hub 36 fixed, as by friction-fit, to the hollow cylindrical section 31 of the nozzle. The latter section of the nozzle is formed with a pair of diametrically-opposed orifices 37*a*, 37*b*. Hub 36 of the carrier member 35 is similarly formed with a pair of diametrically-opposed orifices 36*a*, 36*b* in alignment with orifices 37*a*, 37*b*, for discharging two water jets laterally of the sprinkler. As clearly seen in FIG. 1, orifices 37*a*, 37*b* and 36*a*, 36*b* are upwardly inclined so as to impart an upward inclination to the water jets discharged therefrom.

The other end of the cylindrical hollow section 31 of the nozzle 3 is formed with a solid stem 31*b* of reduced diameter, which is further reduced in diameter at its tip 31*c*. Tip 31*c* receives a cap 38 for limiting the outward movement of the rotary deflector 4.

Figure 2:
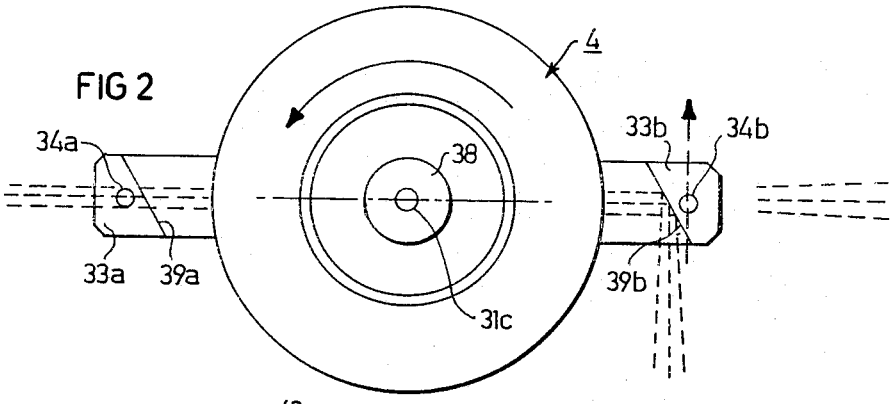
FIG. 2 is a top plan view of the sprinkler of FIG. 1.
Figure 3:
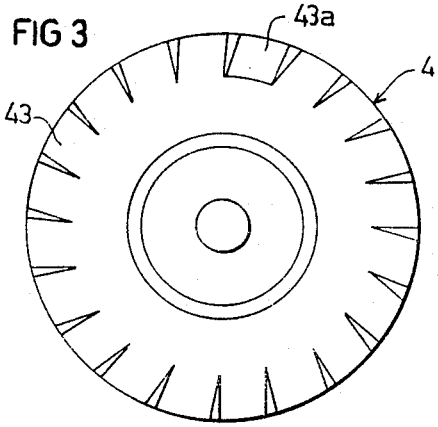
FIGS. 3 and 4 are bottom-plan and side-elevational views, respectively, of the rotary deflector in the sprinkler of FIGS. 1 and 2.
Figure 4:
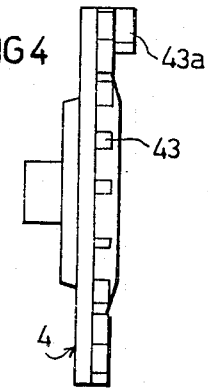

As shown particularly in FIG. 2, each of the impact members 33*a*, 33*b* is formed with an inclined surface 39*a*, 39*b*. These inclined surfaces are oriented so as periodically to be impinged by a portion of the water jets discharged from the nozzle orifices 37*a*, 37*b* and 36*a*, 36*b*, after deflection by the rotary deflector 4, and to impart a stepped rotary movement to the nozzle 3 about its mounting 2.

Rotary deflector 4 is formed with a central opening 41 rotatably received on stem 31*b* of nozzle 3, and is retained against outward movement from the stem by cap 38 applied to tip 31*c* of the nozzle. A plastic bearing disc 42 is interposed between the underface of deflector 4 and the nozzle.

Rotary deflector 4 is further formed with a plurality of vanes, generally designated 43, disposed in a circular array around the circumference of the underface of the deflector and located so to be impinged by the water jets discharged from orifices 37*a*, 37*b* and 36*a*, 36*b* of the nozzle. Vanes 43 may be formed on the underface of the rotary deflector 4 by merely pressing them out of the underface of the deflector, as shown particularly in FIGS. 3 and 4. All the vanes 43 are similar and are pressed out at a similar angle from the rotary deflector, except for one vane, designated 43*a*, which is dissimilar from the other vanes and is pressed out to form a greater angle with respect to the underface of the rotary deflector 4 than the remaining vanes 43.

The similar vanes 43 are formed so as to be impinged by the upper portions of the water jets discharged from the nozzle orifices, and to impart a rotary movement to the deflector 4, leaving the major portion of the water jets to continue in their normal trajectories laterally of the sprinkler. The dissimilar vane 43, however, is configured so as to deflect a portion of the water jets towards the inclined surfaces 39*a*, 39*b* of the two impact members 33*a*, 33*b*, when the rotary deflector 4 is at the angular position of the nozzle wherein the dissimilar vane 43*a* is aligned with the impact members 33*a*, 33*b*; the latter is the condition of the sprinkler shown in FIG. 1.

The sprinkler illustrates in FIGS. 1–4 thus operates as follows: When mounting 2 is connected to a pressurized water supply pipe, the pressurized water flows into the hollow section 31 of nozzle 3 and is discharged in the form of two jets through the aligned orifices 37*a*, 36*a* and 37*b*, 36*b* respectively, on diametrically opposite sides of the nozzle. The upper portions of the water jets continuously impinge against the similar vanes 43 formed on the underface of the rotary deflector 4 so as to rotate the deflector. The dissimilar vane 43*a*, however, also impinged by the water jets, is more sharply inclined than vanes 43, and deflects the water jet downwardly towards the inclined faces 39*a*, 39*b* of the impact members 33*a*, 33*b* so as to rotate the hollow section 31 of the nozzle 3, together with the carrier member 35 and the impact members 33*a*, 33*b*, rigidly attached to it.

Since the impact members 33*a*, 33*b* are impinged by the water jets only when the jets are deflected by the dissimilar vane 43*a*, the rotary movement of the nozzle 3 will be in the form of stepped, intermittent movements, as in the conventional impact-rotary sprinkler, except that the impacts are produced by a liquid body (the water jet) against a solid body (surfaces 39*a*, 39*b* of impact members 33*a*, 33*b*), rather than by two solid bodies, thereby substantially decreasing wear and tear on the impact surfaces.

FIG. 5 illustrates a modification in the construction of the rotary sprinkler of FIGS. 1–4. In the modification of FIG. 5, the nozzle, therein designated 3′, also discharges two water jets, but in this case one water jet, namely that discharged via orifices 37*a*′, 36*a*′, does not impinge against any of the vanes 43′ or 43*a*′ of the rotary deflector 4′, whereas the other water jet, namely that discharged through orifice 37*b*′, 36*b*′, impinges against both the similar vanes 43′, and the dissimilar vane 43*a*′, in the same manner as the two water jets in the FIGS. 1–4 embodiment. The embodiment of FIG. 5 is otherwise constructed and operates in the same manner as that of FIGS. 1–4, except that it provides a slightly larger water distribution range. It will be appreciated that the water jet discharged via orifice 37*a*′, 36*a*′, can be of larger or smaller cross-section than the other water jet, depending upon the water distribution pattern desired.

Figure 7:
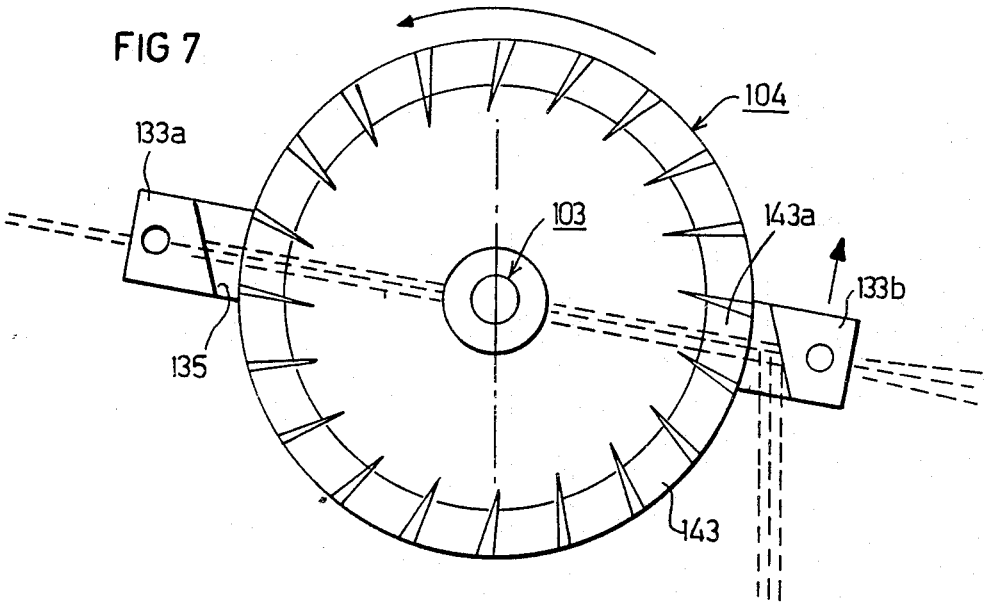
FIG. 7 is a top plan view of the sprinkler of FIG. 6.

FIGS. 6 and 7 illustrate a second embodiment of the invention, also including: a mounting, generally designated 102; a nozzle, generally designated 103; and a rotary deflector, generally designated 104. In the sprinkler of FIGS. 6 and 7, however, the vanes 143 of the rotary deflector 104 are formed on the outer face of the rotary deflector, namely that facing away from the mounting 102, rather than on the inner face facing the mounting as in FIGS. 1–5. Also, instead of providing a dissimilar vane, corresponding to vane 43*a* in the embodiment of FIGS. 1–5, for causing the water jets to periodically impinge against the impact members 133*a*, 133*b*, the rotary deflector instead is formed with a space, shown at 143*a* in FIGS. 6 and 7 in the circular series of vanes 143, so as to permit the water jets to pass unimpeded to the impact members 133*a*, 133*b*.

More particularly, the nozzle 103 also includes a hollow cylindrical section 131 rotatably received within an opening 122 within the mounting member 102, except that the inner end of nozzle section 131 is externally threaded for receiving a nut 131*a*. As in FIG. 1, a plastic bearing disc 132 is interposed between nut 131*a* and the inner face of mounting 102.

In the embodiment of FIGS. 6 and 7, the carrier member 135 for the impact members 133*a*, 133*b* is intergrally formed with the hollow cylindrical section 131 of the nozzle 103, and the rotary deflector 104 is rotatably mounted on the hollow nozzle section 131 to freely rest on the carrier member 135. In addition, the nozzle orifices 137*a*, 137*b* are formed so as to direct the water jets discharged therefrom in the horizontal direction over the outer faces of the rotary deflector 104 and to impinge against the vanes 143 formed around the periphery of the outer surface of the deflector. Vanes 143 are all of similar configuration and are effective, when impinged by the water jets from orifices 137*a*, 137*b*, to deflect the water jets upwardly as shown at the left side of FIG. 6; however, one location, shown at 143*a* at the right side of FIG. 6, is formed without a vane 143, or with a vane which is ineffective to deflect the water jet upwardly, whereby the water jet at that location of the rotary deflector is permitted to pass horizontally and to impinge against the inclined surfaces 139*a*, 139*b* of the impact members 133*a*, 133*b*.

The sprinkler illustrated in FIGS. 6 and 7 thus operates in substantially the same manner as that described above with respect to FIGS. 1–5, in that the water jet impinges against the similar vanes 143 to rotate deflector 104 with respect to the nozzle 103, and also periodically, when passing through the vane-vacant space 143*a*, impinges against the impact members 133*a*, 133*b* to impart a stepped rotary movement to the nozzle 103. In the embodiment of FIGS. 6 and 7, however, the water jets being applied to the outer surface of the rotary deflector 104, also prevent the rotary deflector 104 from moving outwardly with respect to the nozzle; this embodiment thereby obviates the need for a stop member, corresponding to cap 38 in FIGS. 1–4, for preventing the outward movement of the rotary deflector during the normal operation of the sprinkler.

Figure 8:
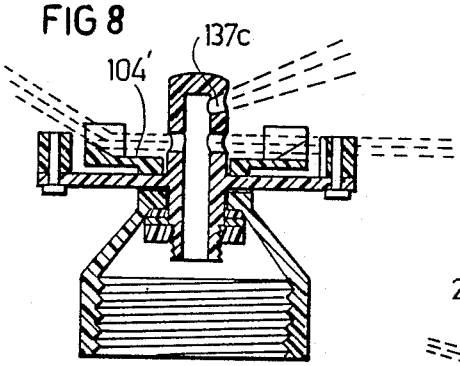
FIG. 8 is a longitudinal sectional view of the sprinkler of FIG. 6 but illustrating a modification.

FIG. 8 illustrates a construction similar to that of FIGS. 6 and 7, except that the nozzle is formed with a third orifice, therein designated 137*c*, for discharging a third water jet at an upward inclination so that the water jet does not impinge any of the vanes on the rotary deflector 104'. The sprinkler illustrated in FIG. 8 is otherwise constructed and operates in the same manner as described above with respect to FIGS. 6 and 7, except that the provision of the third water jet via orifice 137*c*, being unimpeded by the rotary deflector, increases the range of the water sprinkler.

Figure 9:
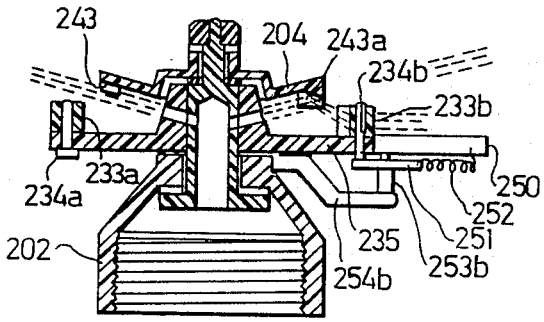
FIG. 9 is a longitudinal sectional view illustrating a sector-type sprinkler constructed in accordance with the present invention and including an arrangement for periodically reversing the direction of rotation of the nozzle.
Figure 10:
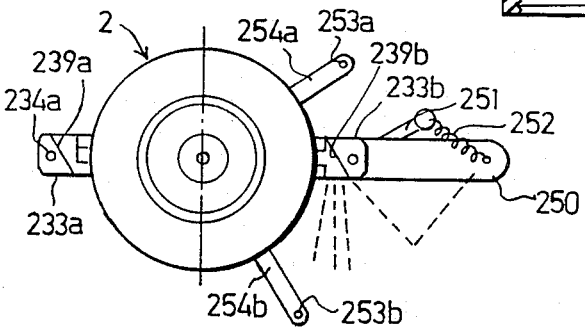
FIG. 10 is a top plan view illustrating the sector-type sprinkler of FIG. 9.

FIGS. 9 and 10 illustrate a further sprinkler construction showing how the invention may be embodied in a sector-type sprinkler for distributing the water in a predetermined sector around the sprinkler, rather than for the complete 360° around the sprinkler. For this purpose, the sprinkler includes a mechanism for periodically reversing the direction of rotation of the nozzle. While the sprinkler illustrated in FIGS. 9 and 10 is of the type shown in FIGS. 1–4, it will be appreciated that the periodic-reversing mechanism therein illustrated could also be applied to the sprinkler of FIGS. 6–8 in order to convert it to a sector-type sprinkler.

The sprinkler illustrated in FIGS. 9 and 10, being basically the same construction as that of FIGS. 1–4, is illustrated with the same reference numerals as that of FIGS. 1–4, but increased by "200". Thus, the rotary deflector 204 is formed on its underface with a plurality of similar vanes 243 which are impinged by the water jets discharged from the nozzle 203 to rotate the rotary deflector, and with a dissimilar vane 243*a* which periodically deflects the water jets towards the abutment members 233*a*, 233*b* for imparting a stepped, rotary movement to the nozzle with respect to its mounting 202.

The sprinkler of FIGS. 9 and 10, however, further includes a mechanism for periodically reversing the direction of rotation of the nozzle 203. For this purpose, one or both of the impact members 233*a*, 233*b* are pivotably mounted to their respective pins 234*a*, 234*b*, so that the impact members can be pivoted 90° to assume one of two stable positions. In addition, an over-center actuator mechanism is provided for pivoting the impact member to either of these positions, and an abutment member carried by the nozzle mounting is engageable with the actuator mechanism to pivot the impact member at a predetermined angular position of the nozzle with respect to its mounting.

As more particularly shown in FIGS. 9 and 10, impact member 233*b* is pivotably mounted via its pin 234*b* to the carrier member 235, and the respective end of the carrier member is formed with an extension as shown at 250. A link 251 is fixed at one end to pin 234*b*, and the opposite end of the link is pivotably mounted to one end of a spring 252, the opposite end of the spring being fixed to the outer end of extension 250. Link 251 and spring 252 thus provide an over-center actuator mechanism for pivoting pin 234*b* and its impact member 233*b* either to the full-line position illustrated in FIG. 10, or to the broken-line position.

An abutment member 253*a*, 253*b* is carried at the end of each of two brackets 254*a*, 254*b* which are selectively positionable on the mounting 202 at the desired angular positions defining the sector to receive the water from the sprinkler.

The sprinkler illustrated in FIGS. 9 and 10 operates as follows:

Assuming impact member 233*b* is in the position wherein its inclined surface 239*b* is as shown in full lines in FIG. 10, the periodic impingement of the water jet against that inclined surface will cause the nozzle 203 to rotate counter-clockwise in the direction of abutment member 253*a*. When link 241 engages abutment member 253*a*, the latter member actuates the over-center mechanism including link 251 and spring 252 to the broken-line position illustrated in FIG. 10, thereby pivoting impact member 233*b* to the broken-line position of its inclined surface 239*b*. When this occurs, the impingement of the water jet against inclined surface 239*b* now causes the sprinkler to rotate in the opposite direction, i.e., clockwise towards abutment member 253*b*, until the latter member engages link 251 to again actuate the over-center mechanism to pivot impact member 233*b* to the full-line position of its inclined surface 239*b*, and thereby to again reverse the direction of rotation of the nozzle.

While the invention has been described with respect to several preferred embodiments, it will be appreciated that many variations may be made. For example, the nozzle may discharge only one water jet, rather than two or three, and the nozzle may include only one impact member, or more than two such members if desired. Further, the sprinkler could include more than one dissimilar vane or more that one space between the similar vanes, effective to direct a portion of the water jet to impinge against the impact member. Further, the invention could be embodied in the bridge-type sprinkler, or other types of rotary sprinklers.

Many other variations, modifications and applications of the invention will be apparent.

What is claimed is:

1. A rotary sprinkler including a mounting, a nozzle rotatably mounted thereon and formed with an orifice for discharging a water jet, an impact member carried by said nozzle for periodically receiving impacts effective to rotate the nozzle about its mounting, and a rotary deflector rotatably mounted with respect to said nozzle and having a circular array of a plurality of vanes in the path of the water jet effective to be impinged by the water jet and thereby to rotate the deflector, said deflector having jet-directing means in the path of the water jet at a predetermined angular position of the deflector with respect to the nozzle and effective, when the deflector is in said predetermined angular position, to cause at least a portion of the water jet to be directed against said impact member to rotate the nozzle about its mounting.

2. The sprinkler according to claim 1, wherein said jet-directing means comprises a further vane dissimilar from said plurality of vanes and effective to deflect at least a portion of the water jet against said impact member when the deflector is in said predetermined angular position with respect to the nozzle.

3. The sprinkler according to claim 2, wherein said nozzle orifice is formed to discharge the water jet laterally of the nozzle and its mounting.

4. The sprinkler according to claim 3, wherein said impact member is rigidly fixed to said nozzle outwardly of the deflector and includes an impingement surface out of the path of the water jet when impinging against said plurality of vanes but in the path of the water jet when impinging against said further vane.

5. The sprinkler according to claim 3, wherein said plurality of vanes and said further vane are formed on the surface of the rotary deflector facing said mounting.

6. The sprinkler according to claim 5, wherein said deflector is rotatably mounted to the nozzle by means of a stem formed on a side of the nozzle facing away from the mounting, said sprinkler further including a stop fixed to said stem for limiting the axial movement of the deflector with respect to the nozzle.

7. The sprinkler according to claim 5, wherein said nozzle is formed with a second orifice for discharging a second water jet laterally of the sprinkler.

8. The sprinkler according to claim 7, wherein said second orifice is oriented at the same angle as said first-mentioned orifice with respect to the deflector so that the second water jet discharged from the second orifice also impinges against said plurality of vanes to rotate the deflector, and against said further vane to be deflected thereby towards said impact member to rotate the nozzle.

9. The sprinkler according to claim 5, wherein said nozzle includes two impact members at diametrically opposite sides of the nozzle.

10. The sprinkler according to claim 1, further including periodic reversing means for periodically reversing the direction of rotation of the nozzle.

11. The sprinkler according to claim 10, wherein said periodic reversing mechanism comprises a pivotal mounting for said impact member pivotably mounting said impact member to the nozzle to assume either a first position or a second position, an over-center actuator mechanism for pivoting the impact member from one position to the other, and an abutment member carried by said nozzle mounting engageable with said actuator mechanism to pivot the impact member from one position to the other at predetermined angular positions of the nozzle with respect to its mounting.

12. The sprinkler according to claim 7, wherein said second orifice is oriented differently from said first-mentioned orifice with respect to the deflector so that the second water jet discharged from the second orifice does not impinge against any of said vanes of the delector.

13. The sprinkler according to claim 1, wherein said jet-directing means comprises a space between said plurality of vanes at said predetermined angular position of the deflector, which space is effective to permit at least a portion of the water jet to impinge against said impact member when the deflector is in said predetermined angular position.

14. The sprinkler according to claim 13, wherein said plurality of vanes are formed on the surface of the deflector facing away from said mounting.

15. The sprinkler according to claim 14, wherein said nozzle includes a cylindrical end, and said deflector is formed with a central opening of slightly larger diameter than said nozzle cylindrical end for rotatably mounting the deflector thereon; said orifice being formed in the nozzle in alignment with said plurality of vanes formed on the surface of the deflector facing away from the nozzle mounting such that the water jet discharged from the nozzle is effective not only to rotate the deflector and to periodically impinge against the impact member, but also to prevent movement of the deflector outwardly of the nozzle during the operation of the sprinkler.

16. The sprinkler according to claim 15, wherein said nozzle is formed with a second orifice for discharging a second water jet laterally of the sprinkler, said second orifice being oriented the same as said first orifice with respect to the deflector so that the second water jet discharged from the second orifice also impinges against said plurality of vanes to rotate the deflector.

17. The sprinkler according to claim 16, wherein said nozzle includes a third orifice for discharging a third water jet laterally of the sprinkler, said third orifice being oriented differently from said first and second orifices with respect to the deflector so that the third water jet discharged from the third orifice does not impinge against said plurality of vanes of the deflector.

18. The sprinkler according to claim 13, wherein said nozzle includes two impact members at diametrically opposite sides of the nozzle.

19. The sprinkler according to claim 15, wherein said nozzle includes a further orifice for discharging a further water jet laterally of the sprinkler, said further orifice being oriented differently from that of said first-mentioned orifice with respect to the deflector so that the further water jet discharged from the further orifice does not impinge against said plurality of vanes of the deflector.

* * * * *